US011304570B1

(12) United States Patent
Shaukat et al.

(10) Patent No.: US 11,304,570 B1
(45) Date of Patent: Apr. 19, 2022

(54) MULTIFUNCTIONAL WEARABLE FLUID DISPENSING APPARATUS

(71) Applicant: IntelWrist, LLC, Miami, FL (US)

(72) Inventors: Kashif Shaukat, Davie, FL (US); Bernard Lagroue, Miramar, FL (US)

(73) Assignee: IntelWrist, LLC, Miami, FL (US)

( * ) Notice: Subject to any disclaimer, the term of this patent is extended or adjusted under 35 U.S.C. 154(b) by 0 days.

(21) Appl. No.: 17/155,607

(22) Filed: Jan. 22, 2021

(51) Int. Cl.
*A47K 5/12* (2006.01)

(52) U.S. Cl.
CPC ..... *A47K 5/1201* (2013.01); *A47K 5/1217* (2013.01)

(58) Field of Classification Search
CPC ..... A47K 5/1201; A47K 5/1217
See application file for complete search history.

(56) References Cited

U.S. PATENT DOCUMENTS 6,983,864 B1 * 1/2006 Cagle ..... B05B 11/0005 222/131
10,042,984 B2 * 8/2018 Zaima ..... G16H 40/20
10,285,642 B2 * 5/2019 Ahmad ..... A61B 5/082
2002/0170309 A1 * 11/2002 Strauss ..... A61F 7/00 62/314
2004/0164102 A1 * 8/2004 Green ..... G01F 11/028 222/321.7
2005/0229973 A1 * 10/2005 Holm ..... A47K 5/18 137/360
2009/0069749 A1 * 3/2009 Miller ..... A61M 5/1413 604/151
2010/0303536 A1 * 12/2010 Geesbreght ..... A47K 5/1201 401/196
2015/0109107 A1 * 4/2015 Gomez ..... G06K 19/0723 340/10.1
2018/0192832 A1 * 7/2018 Shaukat ..... A44C 5/14

FOREIGN PATENT DOCUMENTS

CN 105320370 A * 2/2016
CN 208820774 U * 5/2019

* cited by examiner

*Primary Examiner* — Vishal Pancholi
*Assistant Examiner* — Bob Zadeh
(74) *Attorney, Agent, or Firm* — Kilpatrick Townsend & Stockton LLP

(57) ABSTRACT

A wearable fluid-dispensing apparatus includes a frame including a bottom wall, an upper wall, and a pair of lateral walls defining a receptacle, a cartridge removably attached to the frame within the receptacle of the frame, the cartridge having an interior reservoir, a fluid extraction port, and a fluid transfer conduit disposed within the interior reservoir of the cartridge. A housing located above the upper wall of the frame including an electric pump assembly in communication with the fluid transfer conduit of the cartridge. The electric pump assembly includes a rotatable nozzle disposed above a top end of the housing.

18 Claims, 9 Drawing Sheets

MULTIFUNCTIONAL WEARABLE FLUID DISPENSING APPARATUS

FIELD

The present disclosure generally relates to multifunctional wearable devices for sanitization, health, and hygiene. In particular, the present disclosure relates to a multifunctional wearable fluid dispensing apparatus for automated administration of a fluid composition.

BACKGROUND

Concerns about personal hygiene have become increasingly prevalent in modern society. Since the beginning of the SARS-CoV-2 pandemic, there has been an increased awareness and concern for preventing contamination and infection. The general public is aware of an increasing spread of viruses, threats of epidemics, leading to a general heightened awareness of the multitude of germs that we come in contact with every day. For most people, good hygiene is now an integral part of their daily routine. Among other hygienic practices, for example, individuals wash their hands before and after preparing and/or eating food, after handling an object, or after coming into contact with a potentially unsanitary surface. Various products are available to help sanitize an individual's hands, for example, wipes infused with a liquid antibacterial solution, antibacterial soaps, alcohol-based sanitizers, and the like.

The Clean Hands campaign by the U.S. Centers for Disease Control and Prevention (CDC) instructs the public to use alcohol-based sanitizers for hand washing if soap and water are not readily available. Specifically, the CDC advises using sanitizer that contains at least 60% alcohol or contains a "persistent antiseptic." Alcohol-based sanitizers can kill many different kinds of bacteria, including antibiotic-resistant bacteria, TB bacteria, many kinds of viruses, including the flu virus, the common cold virus, coronaviruses, SARS-CoV-2, H1N1 virus, Norovirus, and *Clostridium difficile*. In some cases, alcohol-based sanitizers are more effective against viruses than most other forms of hand washing. Isopropyl alcohol will kill 99.99% or more of all non-spore forming bacteria in less than 30 seconds, both in the laboratory and on human skin.

The importance of cleanliness has long been recognized, particularly in the fields of health care, food preparation, employee of an organization and laboratories, to name a few. Although traditional hand washing using soap and water is performed by most people, one can unwittingly be exposed to unsanitary conditions after washing their hands. For example, there is risk of potential exposure to unsanitary surfaces by touching a handrail of a stairway or escalator, and/or when opening doors, handling currency, touching keyboards, etc. Thus, sanitizer dispensers are used in a wide variety of settings to provide a sanitizing material to clean hands prior to undertaking activities where cleanliness is important, such as prior to eating, handling food, or attending to a patient at a health care facility.

Wearable dispensers of fluids (e.g., alcohol-based sanitizers) can provide ready access hand hygiene without the need to visit a fixed hand washing station and can reduce the time required to perform hand hygiene.

SUMMARY

The present disclosure relates to a multifunctional wearable fluid dispensing apparatus. In particular, the present disclosure provides a multifunctional wearable fluid dispensing apparatus including a liquid sanitizing dispenser to maintain hygiene and tackle the ongoing pandemic. Advantageously, the multifunctional wearable fluid dispensing apparatus includes a rotatable nozzle that can rotate and dispense fluid using an electric pump assembly. The electric pump assembly may be actuated upon an action (e.g., movement) detected by a sensor to dispenser the fluid from a removable cartridge of the apparatus. The multifunctional wearable fluid dispensing apparatus can be used many times by replacing and/or refilling a removable cartridge attached the wearable fluid dispensing apparatus. The wearable fluid dispensing apparatus provides users the convenience of not having to carry around a bottle of sanitizer to clean their hands and can also be used to disinfect commonly touched surfaces, thus greatly reducing or preventing spreading bacteria and/or viruses.

In some embodiments, the present disclosure provides an apparatus comprising: a frame comprising an upper wall and a pair of lateral walls defining an receptacle; a cartridge removably attached to the frame within at least a portion of the receptacle of the frame, the cartridge comprising an interior reservoir and a fluid extraction port; a fluid transfer conduit disposed within the interior reservoir of the cartridge and having a lower end disposed proximal to an inner surface of a lower end of the cartridge and an upper end coupled to an inside surface of the cartridge and disposed proximal to the fluid extraction port of the cartridge, a housing located above the upper wall of the frame, the housing comprising an electric pump assembly in communication with the fluid transfer conduit of the cartridge; and a rotatable nozzle removably attached to the electric pump assembly. In some embodiments, the housing further comprises: a sensor; a processor in communication with the sensor, the processor configured to process information from the sensor; and a control unit in communication with the processor and coupled to the electric pump assembly, the processor configured to send a signal to the control unit to actuate the electric pump assembly. In some embodiments, the sensor comprises a touch screen, an accelerometer, a gyroscope, a magnetometer, or combinations thereof. In some embodiments, the control unit is configured to actuate a piston of the electric pump assembly to dispense a fluid from the cartridge based on the signal from the processor. In some embodiments, the rotatable nozzle is configured to rotate along a horizontal axis and a vertical axis. In some embodiments, an emission angle of the rotatable nozzle can be adjusted along a 360° rotation path. In some embodiments, the apparatus further comprises a removable slot in the frame for receiving a radio-frequency identification device. In some embodiments, each of the lateral walls of the frame comprise a fastening member for retaining the cartridge. In some embodiments, the cartridge comprises lateral side walls, each of the lateral side walls comprise a second fastening member that engages the fastening member of the frame. In some embodiments, the cartridge comprises a front face and a rear face, the front face comprising a convex shape and the rear face comprising a substantially flat shape.

In some embodiments, a wearable apparatus is provided, the wearable apparatus comprising: a wristband comprising a first band portion and a second band portion; a frame removably coupled to the first band portion and the second band portion of the wristband, the frame comprising a bottom wall, an upper wall, and a pair of lateral walls defining an receptacle; a cartridge removably attached to the frame within at least a portion of the receptacle of the frame, the cartridge comprising an interior reservoir and a fluid extraction port; a fluid transfer conduit disposed within the interior reservoir of the cartridge and having a lower end disposed proximal to an inner surface of a lower end of the cartridge and an upper end coupled to an inside surface of the cartridge and disposed proximal to the fluid extraction port of the cartridge, a housing located above the upper wall of the frame, the housing comprising an electric pump assembly in communication with the fluid transfer conduit of the cartridge; and a rotatable nozzle removably attached to the electric pump assembly. In some embodiments, the housing further comprises: a sensor coupled to the frame; a processor in communication with the sensor, the processor configured to process information from the sensor; and a control unit in communication with the processor and coupled to the electric pump assembly, the processor configured to send a signal to the control unit to actuate the electric pump assembly. In some embodiments, the sensor comprises a touch screen, an accelerometer, a gyroscope, a magnetometer, or combinations thereof. In some embodiments, the control unit is configured to actuate a piston of the electric pump assembly to dispense a fluid from the cartridge based on a signal from the sensor. In some embodiments, the wearable apparatus further comprises a removable slot in the frame for receiving a radio-frequency identification device. In some embodiments, the wearable apparatus further comprises an LCD device removably attached to the wristband. In some embodiments, the LCD device comprises a housing having a first connection means and a second connection means on opposing sides of the housing.

Numerous benefits are achieved by way of the present disclosure over conventional wearable products. For example, embodiments of the present disclosure provide multifunctional wearable fluid dispensing apparatus that avoids the risk of cross contamination. As explained in the disclosure, the wearable fluid dispensing apparatus can provide automated delivery of fluid composition and can be integrated with other wearable devices. These and other embodiments of the disclosure, along with many of their advantages and features, are described in more detail in conjunction with the text below and attached figures.

DETAILED DESCRIPTION OF EMBODIMENTS

Figure 1:
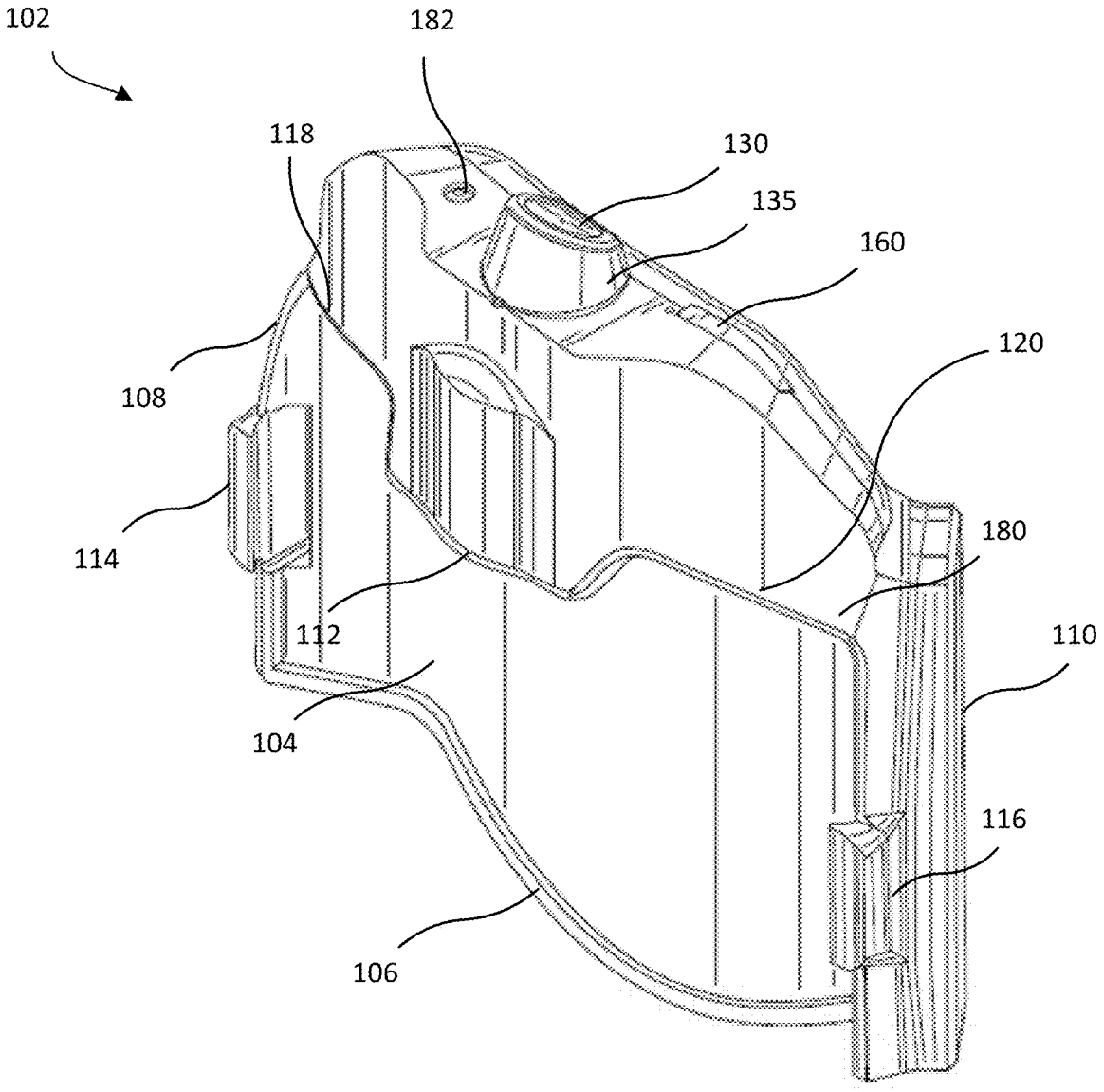
FIG. 1 illustrates a front elevation view of the frame of the wearable fluid dispensing apparatus according to some embodiments of the present disclosure.

The present disclosure describes a number of embodiments related to a multifunctional wearable fluid dispensing apparatus. The multifunctional wearable fluid dispensing apparatus provides a novel and efficient way to sanitize surfaces, personal items, and/or bodily extremities. In particular, the wearable fluid dispensing devices may include an electric pump assembly that is capable of dispensing a fluid upon a triggering action (e.g., touch, hand waving, movement, voice signals, etc.). The wearable devices described herein provide a convenient way to sanitize at any moment with little or no risk of contamination. In some embodiments, the wearable devices comprises a frame for receiving a sealed removable cartridge comprising a fluid (e.g., antibacterial, lotion, etc.) The frame may include an electric pump assembly that engages with a fluid transfer conduit within the removable cartridge to dispense fluid through a rotatable nozzle. Additionally, the wearable devices described herein may be equipped with electronics (e.g., RFIDs, LCD screens, gyroscopes, etc.) to provide additional functionality for the wearable device. For example, the wearable devices may include an RFID tag to monitor location, provide a payment system, and/or as an entry/exit system.

Conventional wearable devices may include a pouch or container for dispensing fluids. These designs have a very high susceptibility for cross contamination or leakage. For example, some conventional wearable devices include a polymer pouch that dispenses fluid when pressure is applied. However, these devices have a risk of contamination as the pouch is not sealed. Additionally, inadvertent pressure applied to the device may waste fluid within the pouch. Some other designs may utilize a removable cartridge that can be refilled. However, these devices also have a risk of contamination due to constantly opening and closing the fluid container. This may lead to reduced efficacy of any of the fluids within the container.

Additionally, a significant portion of the population keep hand sanitizers at a nearby location, for example, in a desk drawer, or even more readily available in a pocket or purse. Small portable sanitizer dispensers are provided specifically so that the sanitizer can be stored in a manner such that it is readily available. The dispensers most commonly employed for these purposes are simply small squeeze bottles closed off by a cap having a dispenser aperture through which the product is dispensed. The small, flexible bottle is typically inverted so that the sanitizer fills the volume near the dispensing aperture while air in the container moves upwardly toward the bottom of the container. The container is then squeezed so that a desired amount of product is forced out of the dispensing aperture. These dispensers are practical and popular, but they serve only the purpose of acting as a dispenser, and they are not as readily accessible as they could be because, in order to be used, they must still be retrieved from a desk drawer, pocket or purse or elsewhere, depending upon where they are stored. Further, constantly retrieving and storing these devices can lead to contamination of the container.

The present disclosure provides a novel and efficient multifunctional wearable fluid apparatus for dispensing a fluid (e.g., an antibacterial) that avoids the risk of contamination and can be integrated with other smart devices. The wearable apparatus includes an electric pump assembly that can dispense a predetermined volume of fluid based on a triggering action. This entirely avoids the need to constantly retrieve and touch the wearable apparatus, thus leading to less cross contamination. As described above, a user can dispense a quantity of fluid by any of a plurality of actions, for example, touching the front face of device, moving the device towards the face and turning the wrist, etc., which can be detected by a sensor integrated into the frame of the wearable device. The sensor can send a signal to a control unit which can simultaneously adjust the rotatable nozzle disposed on the electric pump assembly (e.g., adjust the nozzle perpendicular to the front face of the frame facing away from the user's wrist) and actuate a piston in the electric pump assembly to force a quantity of the fluid through a rotatable nozzle. In some embodiments, the angle of the rotatable nozzle can be adjusted to dispense (e.g., spray) the fluid in a desired direction. For example, if the device is worn on the wrist with frame positioned on the opposite side of the palm, the rotatable nozzle can be adjusted laterally to dispense the fluid at an angle perpendicular to the wrist. The rotatable nozzle can swivel on a XYZ axis to provide a multitude of different spray angles. Additionally, the wearable apparatus includes electronics (e.g., RFIDs, LCD screens, gyroscopes, etc.) to provide additional functionality for the wearable device.

Any implementation described herein as "exemplary" or "illustrative" is not necessarily to be construed as preferred or advantageous over other implementations. All of the implementations described below are exemplary is provided to enable persons skilled in the art to make or use the embodiments of the disclosure and are not intended to limit the scope of the disclosure which is defined by the claims. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

FIG. 1 shows a frame of a wearable fluid dispensing apparatus according to some embodiments. The wearable apparatus may comprise a frame 102 and a removable cartridge 150 (shown in FIG. 2). In some embodiments, the frame 102 has a bottom wall 106 and a pair of opposing side walls, the first side wall 108 and the second side wall 110. In some embodiments, the bottom wall 106 may be slightly curved. The first side wall 108 and the second side wall 110 may be flared outwardly in opposite directions from a pair of opposite side edges of the bottom wall 106, respectively, defining the receptacle 104. The receptacle 104 defines an interior volume of the frame 102 below the housing 120. In some embodiments, the rear wall of receptacle 104 is substantially flat or can be arcuate. The receptacle 104 can be sized, shaped and otherwise has a geometry to conform with and receive a removable cartridge 150 containing a fluid. The wearable fluid-dispensing wearable apparatus can be used with a removable cartridge 150 containing any fluid, for example, an antibacterial fluid, lotion, sunscreen, cleaning solution, etc.

The frame 102 may include one or more fastening members for accepting a removable cartridge 150. In the embodiment shown in FIG. 1, the removable cartridge 150 can be retained within frame 102 by a first clasp 114 and a second clasp 116. In some embodiments, the frame 102 may optionally comprise a central clasp on an upper wall 112 of frame 102 and/or at one end of the bottom wall 106. In some embodiments, the one or more fastening members on the frame 102 may be female fastening members that engage with and receive male fastening members on the removable cartridge 150 to couple the removable cartridge 150 to the frame 102. Alternatively, the one or more fastening members of frame 102 may be male fastening members that engage with female fastening members on the removable cartridge 150. In some embodiments, the fastening members can be interlocking clasps, hook and loop fasteners, magnetic fasteners, frictional fit fasteners, among others. In some embodiments, the frame 102 of the wearable apparatus does not include a bottom wall such that a removable cartridge 150 can slide into the frame 102. In some embodiments, the frame 102 of the wearable apparatus does not include a side wall such that a removable cartridge 150 can slide into the frame 102.

In some embodiments, the frame 102 may comprise an upper wall 112, a first side wall 108, and an opposing second wall 110 that defines the receptacle 104 of the frame 102. The receptacle 104 of the frame 102 can receive the removable cartridge 150. The rear wall of the receptacle 104 of the frame 102 may have an arcuate surface. For example, the rear wall may comprise a central region having a peak and adjacent sections that are lower than the peak. The frame 102 further comprises a first shoulder region 118 and a second shoulder region 120. The first shoulder region 118 is adjacent the first side wall 108 and second shoulder region 120 is adjacent the second side wall 110.

The frame 102 also may have a first clasp 114 extending from the first side wall 108 and a second clasp 116 extending from the second side wall 110 for releasable engagement with the removable cartridge 150 to aid in retaining the cartridge within the receptacle 104 of frame 102. In some embodiments, the first clasp 114 and the second clasp 114 are integrally molded with the first side wall 108 and the second side wall 110 of the frame 102 to form a unitary structure. In some embodiments, the clasps are resilient members of the frame 102 to enable deflection of the clasps for snap-fitting engagement with removable cartridge 150.

The frame 102 may comprise a housing 180 that is disposed above the receptacle 104. In some embodiments, the housing 180 includes the electric pump assembly 130 and other electronics. For example, the housing 180 may comprise a sensor 182 and a slot 160 for receiving an electronics module (e.g., an RFID tag). In some embodiments, the housing 180 may comprise a sensor 182, a processor configured to process information from the sensor, a control unit to actuate the electric pump assembly and/or adjust the rotatable nozzle 135, as further shown in FIG. 6B. The housing 180 may further include a battery and electrical circuitry. The central region of the housing 180 includes the pump assembly 130. The pump assembly 130 includes a pump in fluid communication with the interior reservoir of the removable cartridge 150 (shown in FIG. 2) via a fluid extraction passageway. A rotatable nozzle 135 may be removably attached to the pump assembly 130. The rotatable nozzle 135 can be manually adjusted in any lateral (x-axis) or longitudinal direction (y-axis), as shown in FIG. 3. In some embodiments, the sensor 182 can detect a target location to dispense fluid and the rotatable nozzle 135 can be adjusted by the control unit accordingly.

Figure 2:
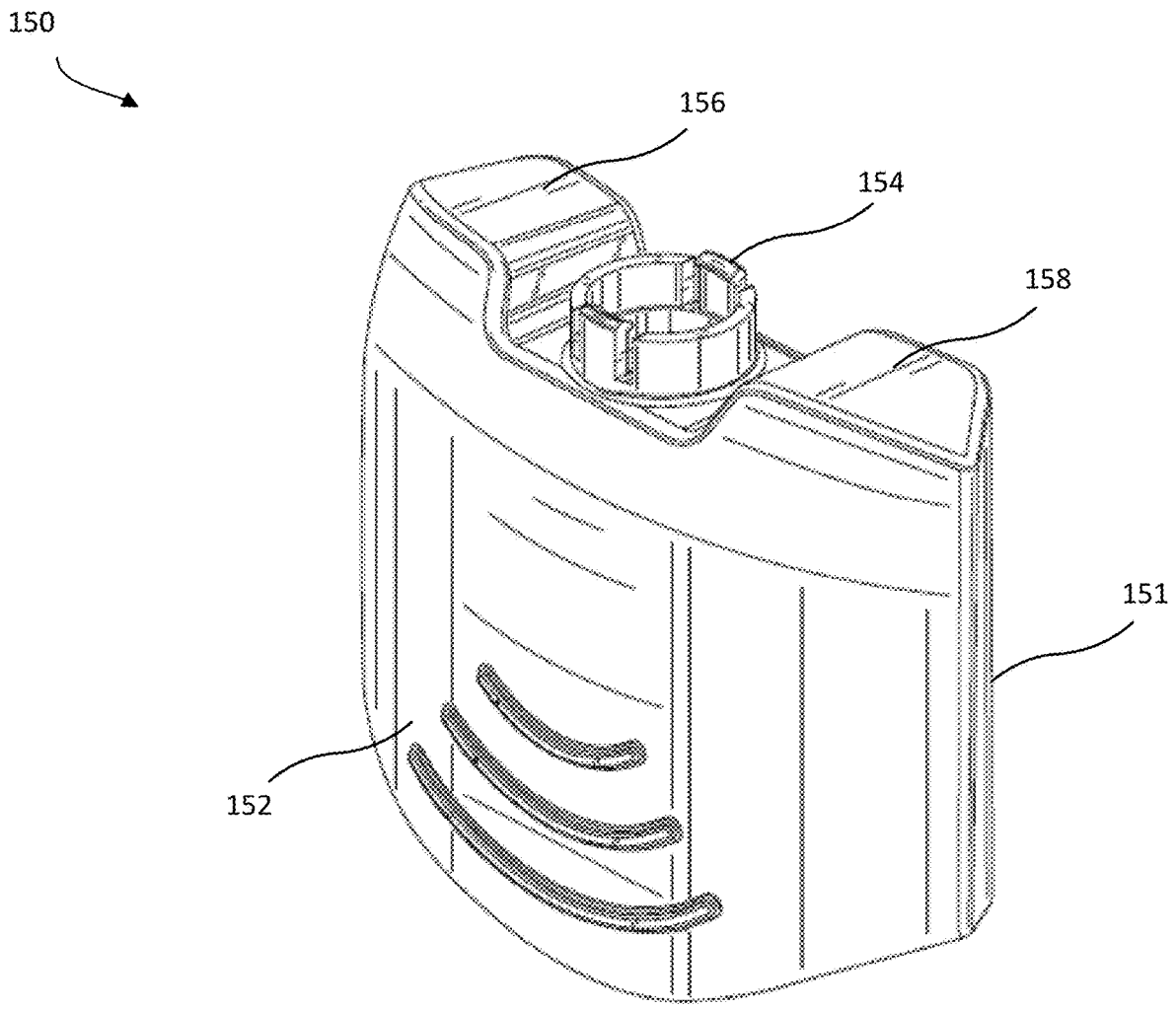
FIG. 2 illustrates a front elevation view of the removable cartridge of the wearable fluid dispensing apparatus according to some embodiments of the present disclosure.
Figure 3:
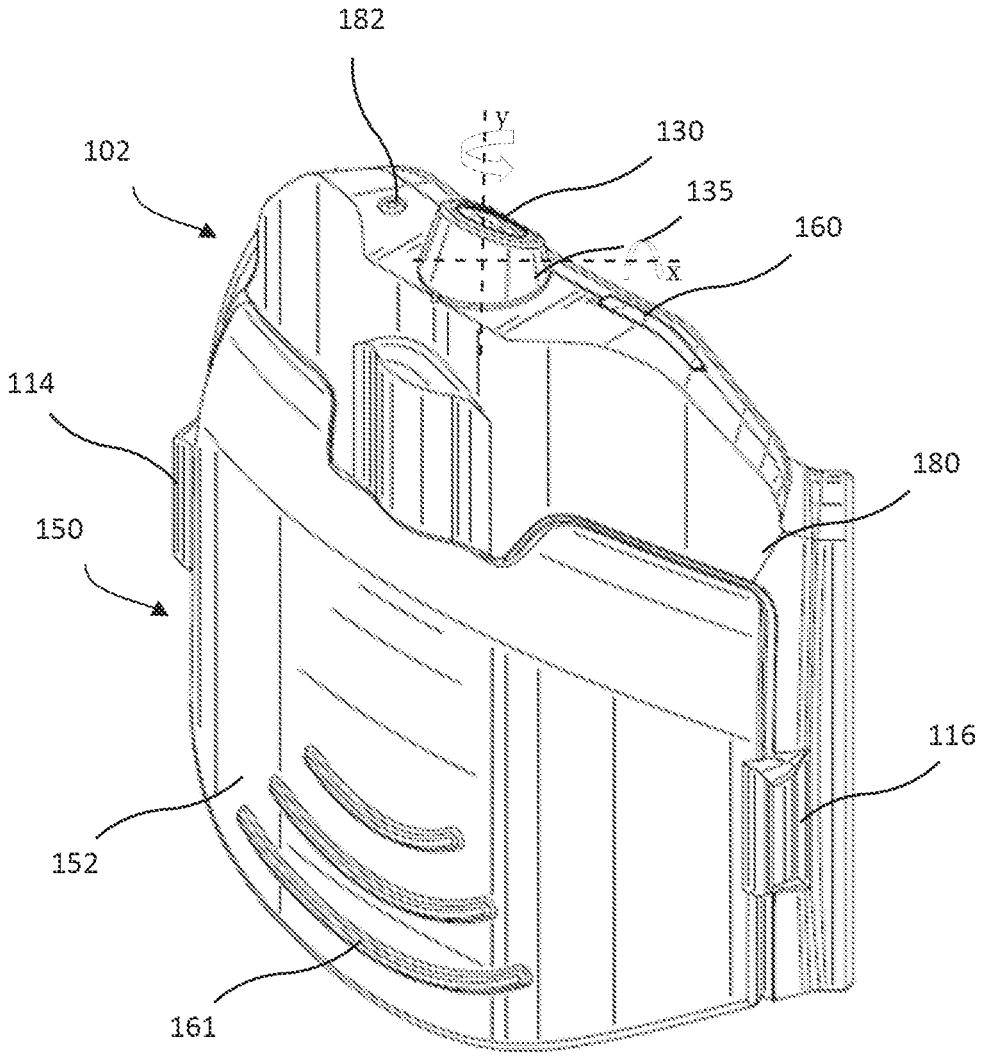
FIG. 3 illustrates a front elevation view of the removable cartridge coupled to the frame of the wearable fluid dispensing apparatus according to some embodiments of the present disclosure.

FIG. 2 shows a cartridge 150 according to some embodiments of the present disclosure. In some embodiments, the cartridge 150 is a removable cartridge that is configured to be coupled to the receptacle 104 of the frame 102 shown in FIG. 1. The removable cartridge 150 comprises a container 151 defining an interior reservoir 152 for retaining a volume of fluid. In some embodiments, the fluid can be an antibacterial solution, an alcohol-based solution, a scented solution, or combinations thereof. The rear wall (not shown) of the removable cartridge 150 may comprise a curvature that corresponds to the curvature of the rear wall of the frame 102. In some embodiments, the removable cartridge 150 comprises a first shoulder region 156 and a second shoulder region 158. In some embodiments, the removable cartridge 150 includes a grip area that can be included on the front exterior surface of the cartridge 150 to aid in the removal and insertion of the cartridge 150.

As shown in FIG. 2, the cartridge 150 also defines an extraction port 154. In some embodiments, the extraction port 154 is an annular-shaped extraction port 154 that is disposed between the first shoulder region 156 and the second shoulder region 158. For example, the annular-shaped extraction port 154 may be disposed at a top center of the cartridge 150 for engagement with an annular housing 132 of the pump assembly 130. In some embodiments, a bulge is formed at a central bottom portion of the cartridge 150 to provide a low point for pooling fluid. For example, an antibacterial fluid can pool at the low point in order to minimize waste of the antibacterial fluid. In some embodiments, the cartridge 150 is constructed of a translucent (clear) material. This facilitates viewing through the cartridge to determine the relative quantity of fluid remaining. Although not depicted, it will be apparent to those skilled in the art that the cartridge 150 may be constructed having hash marks for determining the remaining volume of fluid.

FIG. 3 shows the removable cartridge 150 coupled to the frame 102 according to some embodiments of the present disclosure. As shown in FIG. 3, the receptacle 104 of the frame 102 can receive the removable cartridge 150 such that it is flush with the front face of the frame 102. In some embodiments, the removable cartridge 150 can be retained within the frame 105 by a first clasp 114 and a second clasp 116. A grip area 161 can be included on the front exterior surface of the cartridge 150 to aid in the removal and insertion of the cartridge 150.

In some embodiments, the annular housing 132 of the pump assembly 130 closely fits or engages with the extraction port 154 of the removable cartridge when the cartridge 150 is fully engaged with the frame 102 and retained in place by one or more fastening members. In some embodiments, the pump assembly 130 closely fits or engages with the extraction port 154 of the removable cartridge 150 to provide a leak-proof seal at the extraction port 154. In some embodiments, an upper end of a fluid transfer conduit is spaced below the extraction port 154 of the cartridge 150 and extends downward through the interior reservoir 152 of the cartridge 150 substantially to the bottom of the cartridge bulge for maximum extraction of the antibacterial fluid therein. In some embodiments, the fluid transfer conduit is disposed within the interior reservoir of the cartridge 150 and having a lower end disposed proximal to an inner surface of a lower end of the cartridge and an upper end coupled to an inside surface of the cartridge and disposed proximal to the fluid extraction port 154 of the cartridge. In some embodiments, a rotatable nozzle 135 can be removably attached to the pump assembly 130. The rotatable nozzle 135 can be angled and oriented (hereinafter "emission angle") that can be adjusted for a desirable emission angle. For example, the emission angle can range from 0° to 180°. In some embodiments, the rotatable nozzle 135 is mounted on the pump assembly 130 and is rotatable about a first axis (e.g., vertical) in relation to other normally fixed parts of the frame. The rotatable nozzle 135 can also be pivotable or rotatable about a second axis (e.g., horizontal), thereby providing a variable emission angle along an XYZ axis. In some embodiments, a single driving means is connected via gears and a clutch mechanism to rotate the rotatable nozzle 135 about the first axis and the second axis to provide an emission angle along a 360° rotation path. For example, a control unit can adjust the emission angle of the rotatable nozzle 135 based on a user input, or the rotatable nozzle 135 can be adjusted based on a target object detected by a sensor.

Figure 4:
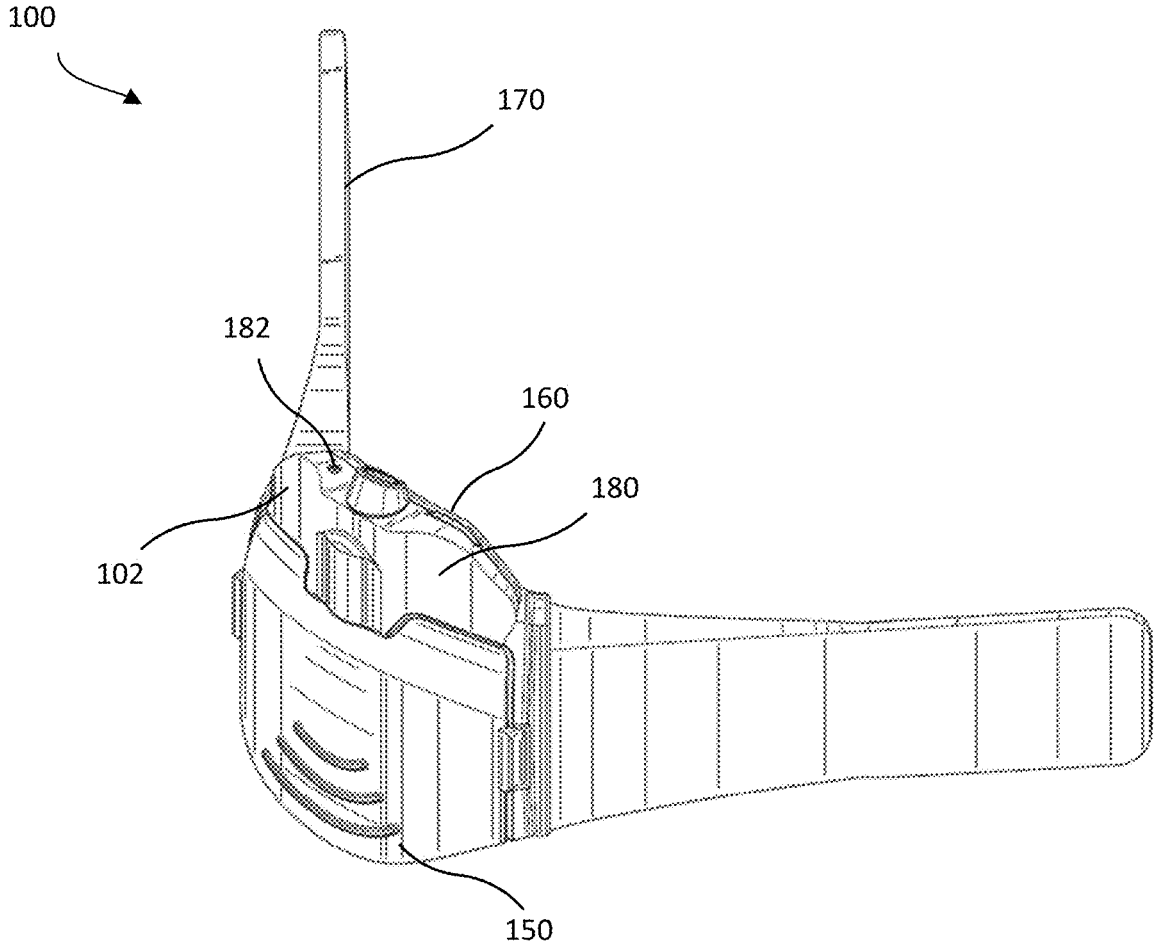
FIG. 4 illustrates a front perspective view of the wearable fluid dispensing apparatus according to some embodiments of the present disclosure.
Figure 5:
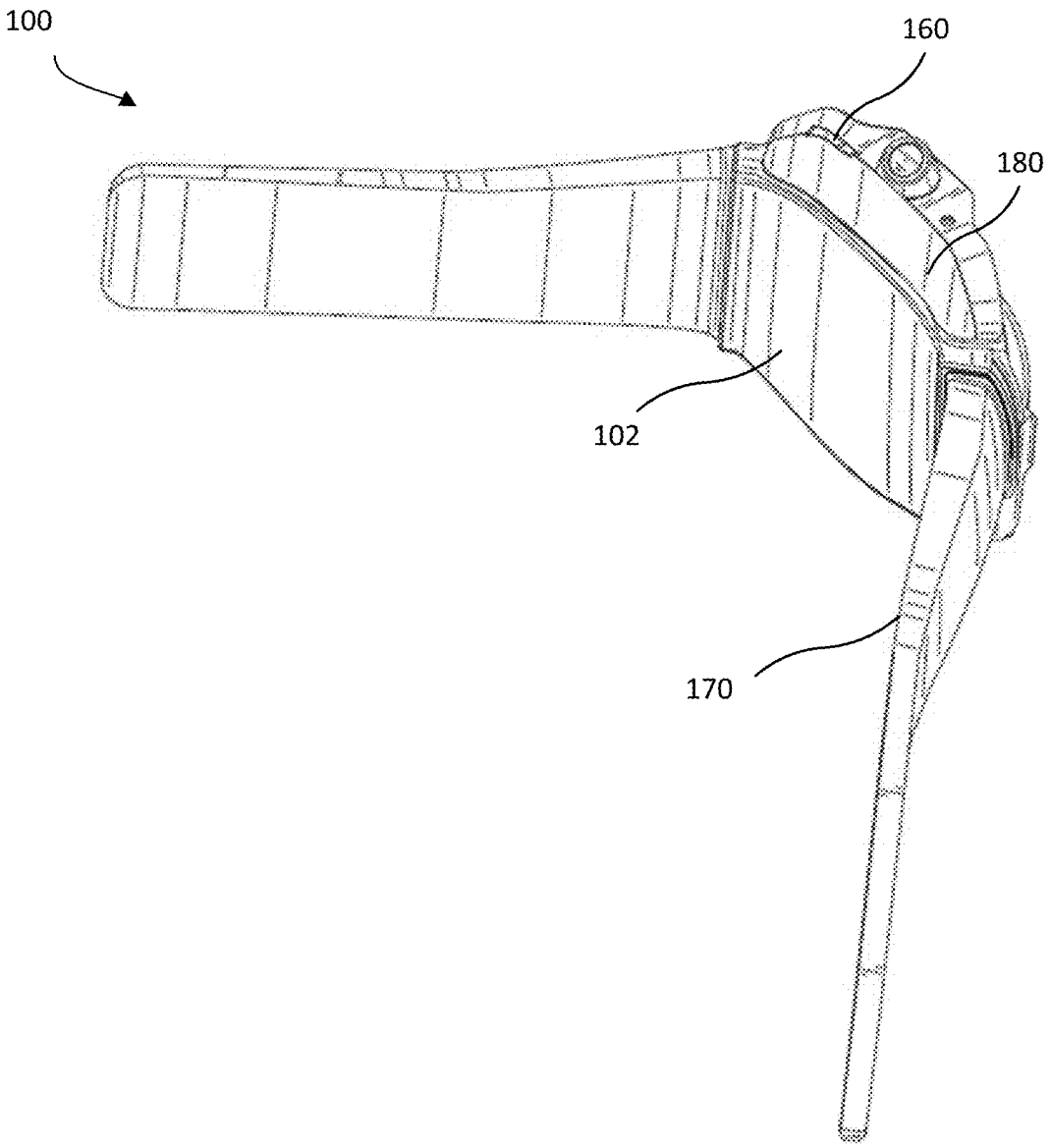
FIG. 5 illustrates a rear perspective view of the wearable fluid dispensing apparatus according to some embodiments of the present disclosure.

FIGS. 4 and 5 show front and rear perspective views of the wearable apparatus 100 according to some embodiments of the present disclosure. In some embodiments, the wearable apparatus 100 may comprise a housing 180 located above the frame 102 for housing, for example, the pump assembly, electronics, and circuitry. In some embodiments, the housing 180 comprises a slot 160 for receiving an electronics module. The slot 160 may comprise brackets defining a receptacle for accepting an electronics module. The receptacle may comprise an outer wall for receiving the electronics module within the slot 160. In some embodiments, the brackets can be mechanically actuated out of the slot to receive the electronics module upon a user action (e.g., touch, push button, etc.). In some embodiments, the slot 160 may receive a radio frequency identification (RFID) tag. An RFID reader can transmit a modulated radio frequency (RF) signal to the RFID tag for a desired function. Passive RFID tags comprise an antenna that receives power transmitted from the reader and couples that power to be used by on-tag circuitry. For example, the on-tag circuitry modulates the input impedance coupled to the antenna between strongly matched and strongly mismatched states which can be detected by the reader to communicate data between the reader and the tag. RFID has a number of standard frequency ranges, each of which offer varying performance characteristics.

In some embodiments, the wristband 170 of the wearable apparatus 100 comprises a slot for receiving an RFID or other identification module to be worn by end-users. The wristband 170 may comprise a two-piece design in that it includes: (a) a base or ID band element with a body that includes a user identification member such as an RFID tag or module at one end; and (b) a sizing or extending band element with a body or spoke that includes a loop or lasso at one end to loop around and attach to the base or ID band element (e.g., over the end containing the user identification member). In some embodiments, an RFID holder is embedded in the wristband. For example, the RFID can be inserted in a pouch located on the wristband. The RFID tag can be provided for a plurality of end uses. For example, the RFID can provide access entry points (e.g., hotel rooms, hospitals, or office buildings), employee tracking (e.g., time keeping, location tracking, etc.), or provide merchant services (e.g., payment systems).

Figure 6A:
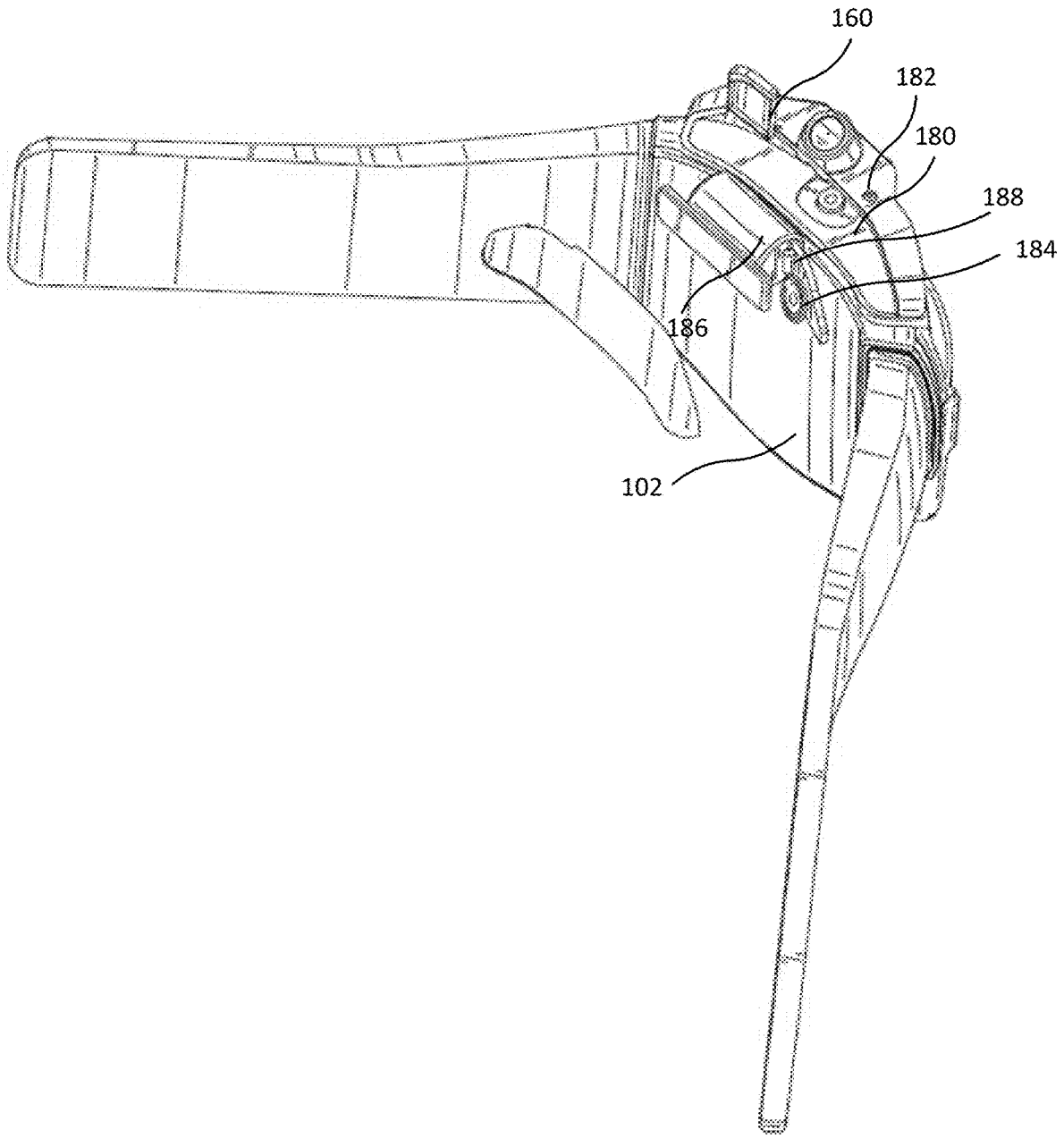
FIG. 6A illustrates an exploded view of the electronics housing of the wearable fluid dispensing apparatus according to some embodiments of the present disclosure.
Figure 6B:
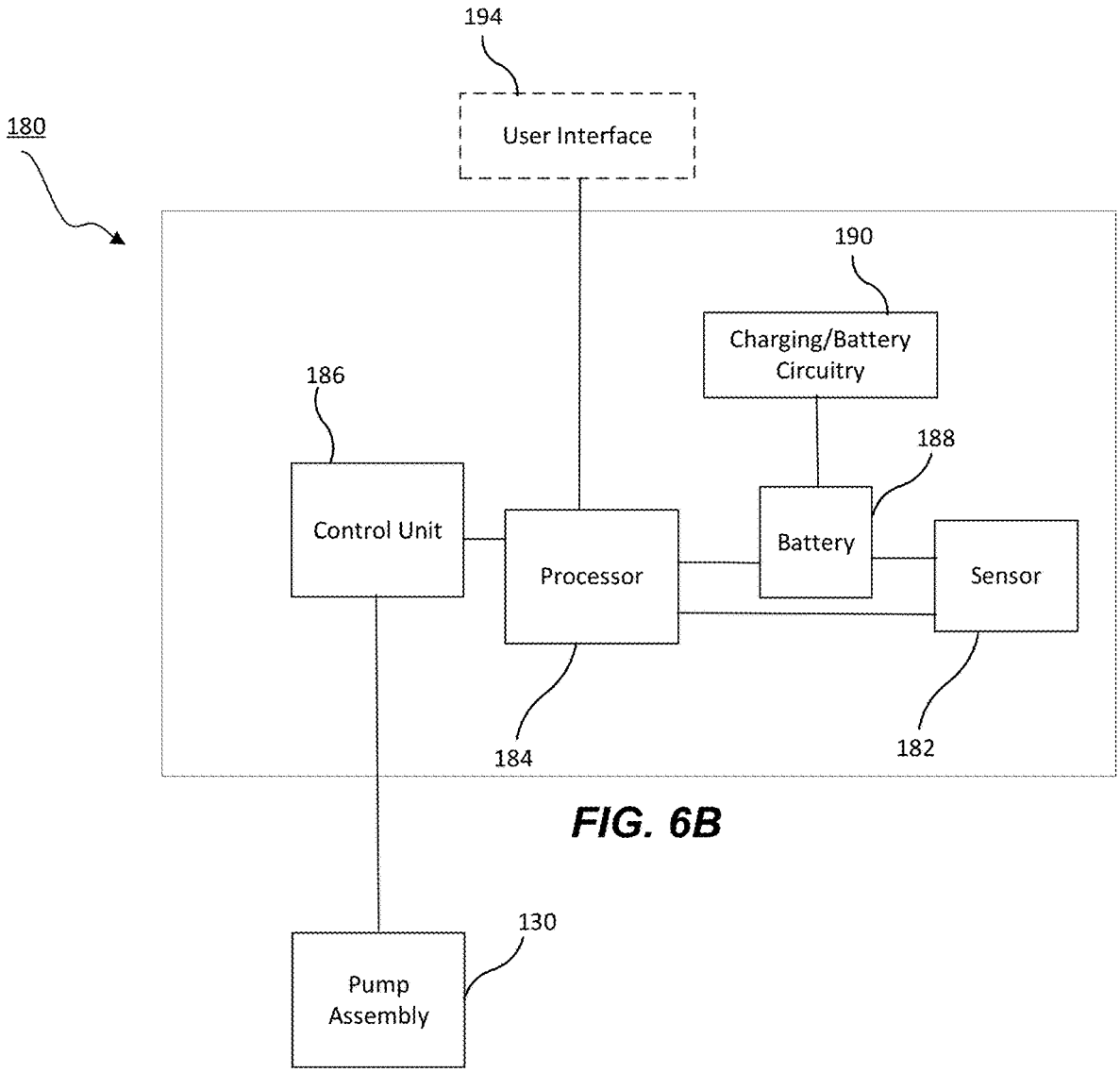
FIG. 6B illustrates a schematic of the electronic components of the wearable fluid dispensing apparatus according to some embodiments of the present disclosure.

As shown in FIGS. 6A and 6B, the wearable apparatus 100 may comprise a housing 180 located above the frame 102. The housing 180 may comprise the electrical components of the wearable apparatus 100. In some embodiments, the housing 180 may include a sensor 182, a processor 184, a control unit 186, a battery 188, and electrical circuitry 190. The sensor 182 can detect an action of user for dispensing a fluid from the removable cartridge 150. For example, the sensor 182 can be a touch screen, an accelerometer, a gyroscope, a magnetometer, or combinations thereof. Based on the sensed action, the processor 184 can send a signal to actuate the control unit 186 (e.g., a gear assembly) to dispense fluid through the pump assembly 130. In some embodiments, the sensor 182 is a microelectromechanical systems (MEMS). The MEMS can be formed by a combination of semiconductor and microfabrication technologies using micro-machine processing to integrate all the electronics, sensors, and mechanical elements onto a common substrate (e.g., silicon substrate). MEMS sensors have many applications in measuring either linear acceleration along one or several axis, or angular motion about one or several axis as an input to control a system. For example, MEMS accelerometer sensors can measure the displacement of a mass with a position-measuring interface circuit. That measurement is then converted into a digital electrical signal through an analog-to-digital converter (ADC) for digital processing. In some embodiments, the sensor 182 is a gyroscope to measure both the displacement of the resonating mass and its frame. In some embodiments, the sensor 182 is an accelerometer to measure linear acceleration (specified in mV/g) along one or several axis. The processor 184 can process the information collected by the sensor 182 to actuate the control unit 186 to dispense fluid from the pump assembly 130. In some embodiments, the battery 188 is a rechargeable battery.

In some embodiments, the pump assembly 130 can be activated according to any of a plurality of actions. In some embodiments, the MEMS integrated within the housing 180 can detect motion of a user to dispense fluid from the cartridge. For example, when the wearable fluid-containing device 100 is turned and moved in an upward motion, the MEMS sends an electrical signal to the processor 184 to actuate the control unit 186 to depress the piston 134 of the pump assembly 130, and then de-activates, by releasing, the piston of the pump assembly, creating a vacuum, or negative pressure, that draws a volume of fluid up through conduit 138 into fluid extraction passageway 133. Subsequently, upon once again activating, by depressing, the piston 134 of the pump assembly 130, pressure forces a volume of the fluid out through rotatable nozzle 135 into the user's hand for subsequent application to the hands and/or other body parts as desired. The piston translation path, which can be seen best in FIG. 7, spans in a downward direction toward the fluid extraction passageway 133 and upward in a direction away from the fluid extraction passageway 133.

As described above, the wearable apparatus 100 comprises an electrical pump assembly 130 for dispensing fluid. The electrical pump assembly 130 comprises a pump in fluid communication with the interior reservoir of the removable cartridge 150 via the fluid extraction passageway 133. In some embodiments, the pump assembly 130 comprises a rotatable nozzle 135 having an outlet orifice through which the fluid within the interior reservoir can be expelled during operation of the pump assembly 130. For example, the removable cartridge 150 has an interior reservoir suitable to contain a fluid (e.g., an antibacterial), a pump assembly 130 in fluid communication with the interior reservoir, and a rotatable nozzle 135 having an outlet orifice through which fluid from the reservoir can be expelled during operation of the pump.

In some embodiments, the electrical pump assembly 130 comprises a control unit 186 (e.g., a motor drive mechanism) for operating the pump assembly 130 and also moving the rotatable nozzle 135. For example, the pump assembly 130 may comprise an electrical motor drive mechanism for operating the pump assembly 130 and also simultaneously moving the rotatable nozzle 135 to modify the direction of spray. The pump assembly 130 is connected to the rotatable nozzle 135 by the fluid transfer conduit 138. In some embodiments, the fluid transfer conduit 138 includes a valve interrupting flow to the rotatable nozzle 135 when the pump assembly 130 is not operating. The rotatable nozzle 135 can connect to the pump assembly 130 via the fluid transfer conduit 138. In some embodiments, the rotatable nozzle 135 includes a rotatable shaft to provide multiple different angles of spray.

In some embodiments, the electrical pump assembly 130 comprises a control system that can optionally delay the start of spraying for a defined period once the unit is activated (to provide time for user to adjust the device), provide automatic shut-off, provide audible or visual (for example flashing light) warnings when the fluid will be dispensed, or combinations thereof. The power usage of this system is quite low as it only needs to be operated for a short period during the dispensing process. In some embodiments, the electrical pump assembly 130 automatically meters out the proper volume of fluid for each spray cycle.

In some embodiments, when a user wishes to dispense fluid, the sensor 182 will detect a triggering action from the user. This processor 184 includes timing circuitry to begin a countdown delaying spraying for a predetermined time, for example, 1 second, 2 seconds, 4 seconds, 5 seconds, or 10 seconds. This affords the user time to position the wearable apparatus 100 for desired spray angle. In some embodiments, a switch can be depressed to dispense the fluid. Unless cancelled by the user, the spray cycle begins automatically at the expiration of the countdown. The control unit 186 is then energized which simultaneously rotates the drive gear of the pump assembly 130 and turns the gear train to rotate the drive shaft and the rotatable nozzle 135. At the same time, the pump assembly 130 draws fluid from the removable cartridge 150 through the fluid transfer conduit 138 and opens valve so that fluid can be expelled through the rotatable nozzle 135 as the nozzle is rotated. In some embodiments, the rotatable nozzle 135 can provide a circular, oscillating spray pattern. This reduces the level of fluid in the cartridge 150, creating a negative pressure in the cartridge, which opens the check valve in the vent tube to aspirate the removable cartridge 150 and allow more fluid to be drawn from the cartridge 150 during the spray cycle.

Figure 7:
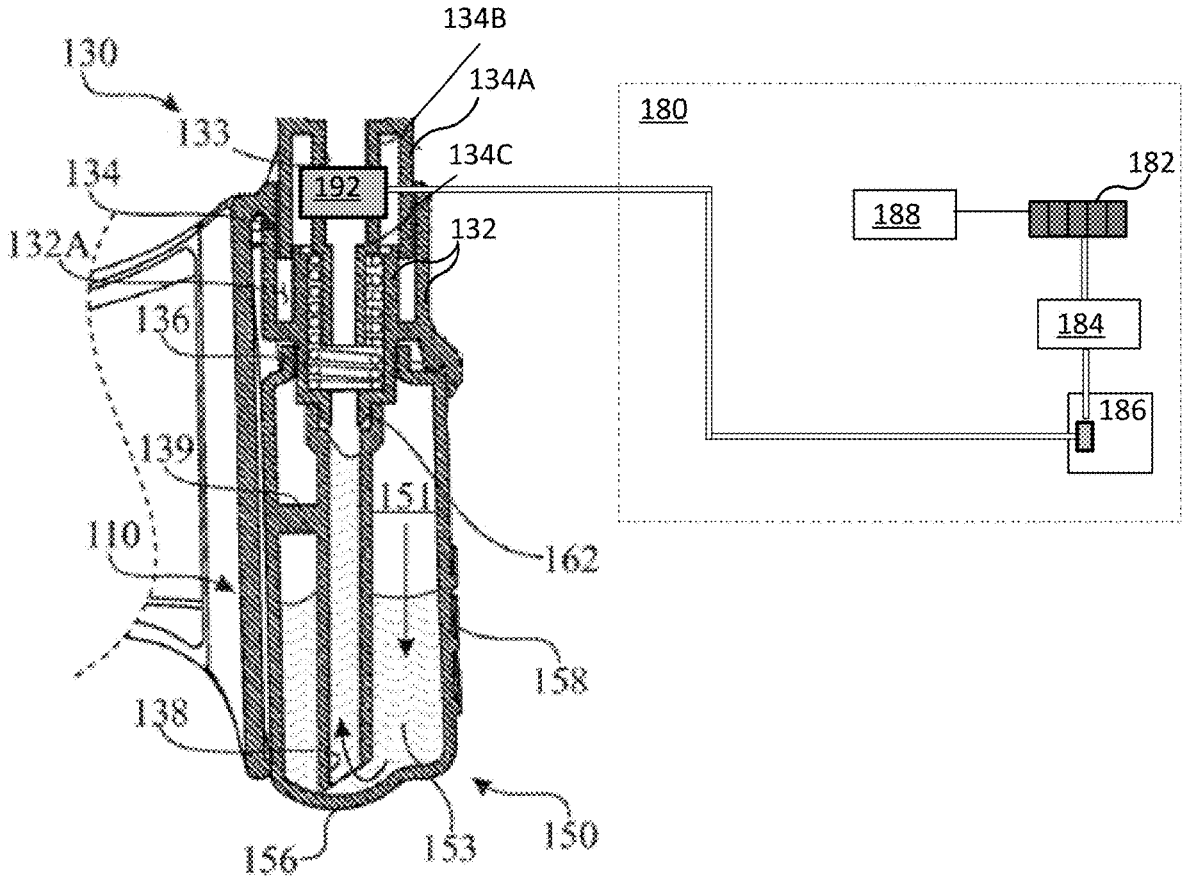
FIG. 7 is a cross-sectional view of the pump assembly of the wearable fluid dispensing apparatus according to some embodiments of the present disclosure.

FIG. 7 shows a cross-sectional view of the pump assembly according to some embodiments of the present disclosure. In some embodiments, the wearable apparatus 100 comprises a pump assembly 130 at the annular housing 132. The pump assembly 130 can be removable attached or integrally formed with the upper wall 112 of the frame 102. In some embodiments, the pump assembly 130 at the annular housing 132 thereof is affixed to, or at regions thereof is integrally formed with, the upper wall 112 of the frame 102. In some embodiments, the annular housing 132 comprises a double-walled structure, which are two concentrically arranged and aligned sidewalls. The pump assembly 130 also includes a piston 134 vertically slidable within and supported by the annular housing 132. In some embodiments, the piston 134 includes a pair of spaced apart exterior portion 134A and interior walled portion 134B and a bottom walled portion 134C attached to, and offset inwardly and extending downwardly from, the interior walled portion 134B. The exterior walled portion 134A of the piston 134 is slidably retained in an annular slot formed within and defined by the double-walled structure of the annular housing 132. The interior walled portion 134B of the piston seats on a top end of, and the bottom walled portion 134C of the piston 134 extends downward through, a biasing spring 136 (e.g., centrally located biasing spring) supported in the annular slot (of the annular housing 132. The interior walled portion 134B and the bottom walled portion 134C of the piston 134 define a centrally-located fluid extraction passageway 133 through the piston 134 and into fluid communication with a fluid transfer conduit 138 (or "dip tube") of cartridge 150, as described herein.

The piston 134 of the pump assembly 130 is translatable between a raised position and a depressed position. The piston 134 defines at an upper portion thereof, protruding beyond the annular housing 132, a rotatable nozzle 135 from which a quantity of fluid, pumped upwardly from the cartridge 150, through the fluid transfer conduit 138 and the fluid extraction passageway 133, is dispensed during activation of the pump assembly 130. An upper end of the biasing spring 136, such as a compression spring, engages the interior walled portion 134B of the piston 134 to bias the piston 134 in the raised position. In some embodiments, the fluid transfer conduit 138 is fixedly attached to the sidewall of the cartridge 150 via an attachment structure 139 such that the conduit 138 is fixedly retained in a generally vertically disposed orientation with a lower end extending into cartridge bulge 156 and an upper end fitted about a lower portion of the annular housing 132 defining a lower port 162 of the pump assembly 130. The annular housing 132 of the pump assembly 130, above the lower port 162 thereof, snugly fits through the extraction port 154, i.e., the cartridge mouth or cartridge port, of the cartridge 150 such that the piston 134 communicates via the fluid extraction passageway 133 through the interior and bottom walled portions 134B and 134C thereof with the interior reservoir 152 of the cartridge 150. A lower end of the biasing spring 136 is seated on an annular shoulder in the extraction port. In some embodiments, the fluid transfer conduit 138, the annular housing 132, and the piston 134 define a fluid pathway extending, centrally through the biasing spring 136, between the interior reservoir of the removable cartridge 150 and the fluid extraction passageway 133 "pump chamber") just shy of the rotatable nozzle 135, wherein the pump chamber can be seen extending from the rotatable nozzle 135, i.e., outlet valve, to the lower port 162, i.e., inlet valve.

In some embodiments, the pump assembly 130 can be activated according to any of a plurality of actions. For example, when the wearable fluid-containing device is turned and moved in an upward motion, the sensor 182 transmit an electrical signal to the processor 184 to actuate the control unit 186 to depress the piston 134 of the pump assembly 130. For example, the control unit 186 may be configured to actuate a drive mechanism 192 for operating the pump assembly 130 and also moving the rotatable nozzle 135. In some embodiments, the control unit 186 may comprise an electrical motor drive mechanism 192 for actuating the piston of the pump assembly 130 and also simultaneously moving the rotatable nozzle 135 to modify the direction of spray. Then, the control unit 186 de-activates the pump assembly 130 by releasing the piston creating a vacuum, or negative pressure, that draws a volume of fluid up through conduit 138 into fluid extraction passageway 133.

In some embodiments, the removable cartridge 150 can be removed and replaced from the frame 102 when the fluid is depleted. For example, when the quantity of fluid has been depleted from the interior reservoir of the removable cartridge 150, the user unfastens the clasps on the frame 102 from engagement with the cartridge 150 to slide the cartridge 150 downward to disengage front the pump assembly 130 and the frame 102. A new cartridge 150 may then be installed by positioning and sliding the extraction port 154 of the cartridge 150 over the lower port 162 of the annular housing 132 of the pump assembly 130 to tear through a cartridge-opening sealing membrane 157 to thereby initiate fluid communication between the interior reservoir 152 and the pump fluid extraction passageway 133, is the conduit 138. Additional quantities of antibacterial, or other composition, fluid can then be extracted by activation of the piston 134 of the pump assembly 130 as previously described.

Figure 8:
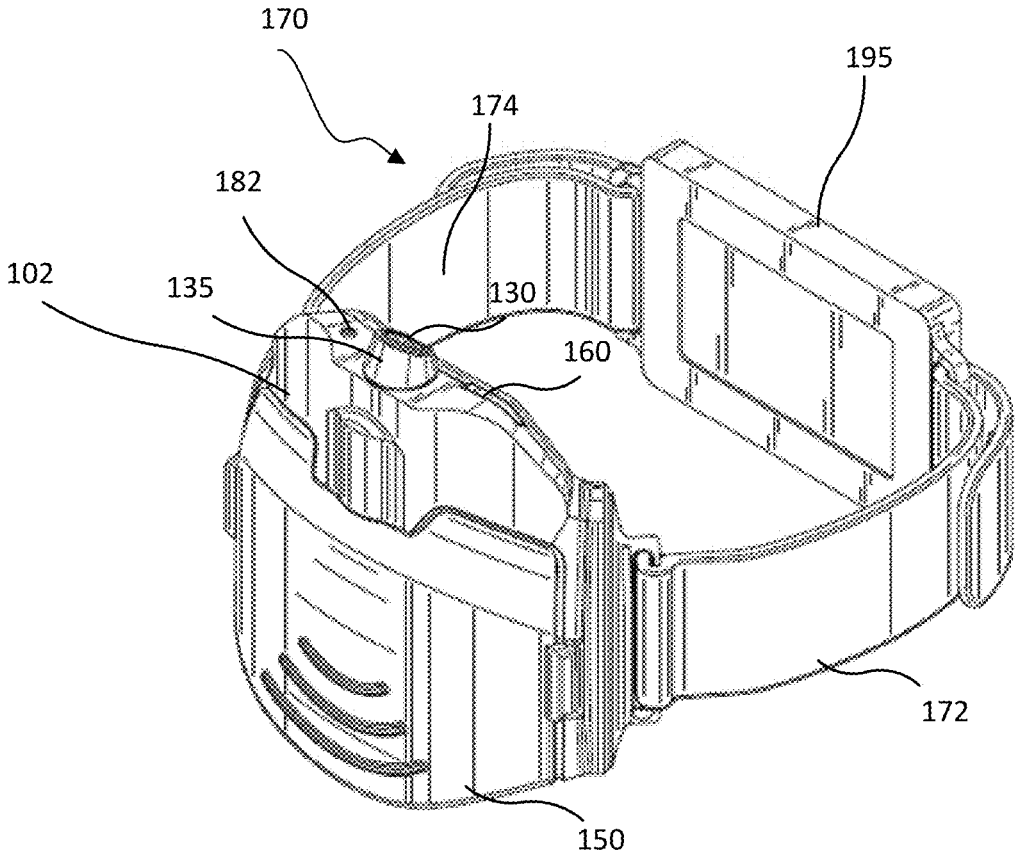
FIG. 8 is a perspective view of a wearable fluid dispensing apparatus according to some embodiments of the present disclosure.

FIG. 8 shows another embodiment of the wearable apparatus according to embodiments of the present disclosure. The wearable apparatus 100 includes a wristband 170. The wristband 170 may include a first band portion 172 and a second band portion 174. In some embodiments, the frame 102 is removably coupled to the first band portion 172 and the second band portion 174 the wristband. In some embodiments, the frame 105 is integrally attached to the wristband 170. For example, the wristband 170 may a single unitary band that be integrally attached to the frame 105.

In some embodiments, the wearable apparatus 100 or wearable apparatus also includes a wearable member formed by a female wristband segment and a male wristband segment. The female wristband segment is affixed to the frame 102 proximate the first lateral side wall. In some embodiments, the female wristband segment has a series of spaced apart apertures along a length thereof to aid in fastening the wearable apparatus to a user's wrist or forearm. In like manner, the male wristband segment is affixed to the frame proximate the second lateral side wall. The male wristband segment may include one or more pegs, or comparable projections, extending therefrom for releasable engagement with selected ones of the apertures of the female wristband to releasably secure the wearable apparatus to a user's wrist or forearm, in a manner well known in the art.

The wristband may include an LCD device 195 removably attached to the wristband. The LCD device 195 comprises a housing having a first connection means and a second connection means on opposing sides of the housing. The wristband comprises a first distal end and second distal end. The first distal end and the second distal end may comprise a magnetic fastening member. In some embodiments, the first distal end and the second distal end are configured to removable attach the wristband to the first connection means and the second connection means of the housing of the LCD device. In some embodiments, the LCD may be in electrical communication with the processor in the housing of the frame. The LCD can be a touch screen that receive inputs from a user. For example, a user can set a predetermined volume of the fluid to be dispensed, set a spray direction, among other user functions.

Illustrations

Illustration 1 is an apparatus comprising: a frame comprising an upper wall and a pair of lateral walls defining an receptacle; a cartridge removably attached to the frame within at least a portion of the receptacle of the frame, the cartridge comprising an interior reservoir and a fluid extraction port; a fluid transfer conduit disposed within the interior reservoir of the cartridge and having a lower end disposed proximal to an inner surface of a lower end of the cartridge and an upper end coupled to an inside surface of the cartridge and disposed proximal to the fluid extraction port of the cartridge, a housing located above the upper wall of the frame, the housing comprising an electric pump assembly in communication with the fluid transfer conduit of the cartridge; and a rotatable nozzle removably attached to the electric pump assembly.

Illustration 2 is the apparatus of any preceding or subsequent illustration, the housing further comprising: a sensor; a processor in communication with the sensor, the processor configured to process information from the sensor; and a control unit in communication with the processor and coupled to the electric pump assembly, the processor configured to send a signal to the control unit to actuate the electric pump assembly.

Illustration 3 is the apparatus of any preceding or subsequent illustration, wherein the sensor comprises a touch screen, an accelerometer, a gyroscope, a magnetometer, or combinations thereof.

Illustration 4 is the apparatus of any preceding or subsequent illustration, the control unit is configured to actuate a piston of the electric pump assembly to dispense a fluid from the cartridge based on the signal from the processor.

Illustration 5 is the apparatus of any preceding or subsequent illustration, wherein the rotatable nozzle is configured to rotate along a horizontal axis and a vertical axis.

Illustration 6 is the apparatus of any preceding or subsequent illustration, wherein an emission angle of the rotatable nozzle can be adjusted along a 360° rotation path.

Illustration 7 is the apparatus of any preceding or subsequent illustration, further comprising a removable slot in the frame for receiving a radio-frequency identification device.

Illustration 8 is the apparatus of any preceding or subsequent illustration, wherein each of the lateral walls of the frame comprise a fastening member for retaining the cartridge.

Illustration 9 is the apparatus of any preceding or subsequent illustration, wherein the cartridge comprises lateral side walls, each of the lateral side walls comprise a second fastening member that engages the fastening member of the frame.

Illustration 10 is the apparatus of any preceding or subsequent illustration, wherein the cartridge comprises a front face and a rear face, the front face comprising a convex shape and the rear face comprising a substantially flat shape.

Illustration 11 is a wearable apparatus comprising: a wristband comprising a first band portion and a second band portion; a frame removably coupled to the first band portion and the second band portion of the wristband, the frame comprising a bottom wall, an upper wall, and a pair of lateral walls defining an receptacle; a cartridge removably attached to the frame within at least a portion of the receptacle of the frame, the cartridge comprising an interior reservoir and a fluid extraction port; a fluid transfer conduit disposed within the interior reservoir of the cartridge and having a lower end disposed proximal to an inner surface of a lower end of the cartridge and an upper end coupled to an inside surface of the cartridge and disposed proximal to the fluid extraction port of the cartridge, a housing located above the upper wall of the frame, the housing comprising an electric pump assembly in communication with the fluid transfer conduit of the cartridge; and a rotatable nozzle removably attached to the electric pump assembly.

Illustration 12 is the apparatus of any preceding or subsequent illustration, the housing further comprises: a sensor coupled to the frame; a processor in communication with the sensor, the processor configured to process information from the sensor; and a control unit in communication with the processor and coupled to the electric pump assembly, the processor configured to send a signal to the control unit to actuate the electric pump assembly.

Illustration 13 is the apparatus of any preceding or subsequent illustration, wherein the sensor comprises a touch screen, an accelerometer, a gyroscope, a magnetometer, or combinations thereof.

Illustration 14 is the apparatus of any preceding or subsequent illustration, the control unit is configured to actuate a piston of the electric pump assembly to dispense a fluid from the cartridge based on a signal from the sensor.

Illustration 15 is the apparatus of any preceding or subsequent illustration, wherein the wearable apparatus further comprises a removable slot in the frame for receiving a radio-frequency identification device.

Illustration 16 is the apparatus of any preceding or subsequent illustration, further comprising an LCD device removably attached to the wristband.

Illustration 17 is the apparatus of any preceding or subsequent illustration, wherein the LCD device comprises a housing having a first connection means and a second connection means on opposing sides of the housing.

Illustration 18 is the apparatus of any preceding or subsequent illustration, wherein the band comprises a first distal end and second distal end, wherein the first distal end and the second distal end comprise a magnetic fastening member.

Illustration 19 is the apparatus of any preceding or subsequent illustration, wherein the first distal end and the second distal end are configured to removable attach the wristband to the first connection means and the second connection means of the housing of the LCD device.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. An apparatus comprising:

a frame comprising an upper wall and a pair of lateral walls defining a receptacle;

a cartridge removably attached to the frame within at least a portion of the receptacle of the frame, the cartridge comprising an interior reservoir and a fluid extraction port;

a fluid transfer conduit disposed within the interior reservoir of the cartridge and having a lower end disposed adjacent to an inner surface of a lower end of the cartridge and an upper end coupled to an inside surface of the cartridge and disposed adjacent to the fluid extraction port of the cartridge, a housing located above the upper wall of the frame, the housing comprising an electric pump assembly in communication with the fluid transfer conduit of the cartridge, wherein the housing further comprises:

a sensor;

a processor in communication with the sensor, the processor configured to process information from the sensor; and a control unit in communication with the processor and coupled to the electric pump assembly, the processor configured to send a signal to the control unit to actuate the electric pump assembly; and a rotatable nozzle removably attached to the electric pump assembly.

2. The apparatus of claim 1, wherein the sensor comprises a touch screen, an accelerometer, a gyroscope, a magnetometer, or combinations thereof.

3. The apparatus of claim 1, wherein the control unit is configured to actuate a piston of the electric pump assembly to dispense a fluid from the cartridge based on the signal from the processor.

4. The apparatus of claim 1, wherein the rotatable nozzle is configured to rotate along a horizontal axis and a vertical axis.

5. The apparatus of claim 4, wherein an emission angle of the rotatable nozzle can be adjusted along a 360° rotation path.

6. The apparatus of claim 1, further comprising a removable slot in the frame for receiving a radio-frequency identification device.

7. The apparatus of claim 1, wherein each of the lateral walls of the frame comprise a fastening member for retaining the cartridge.

8. The apparatus of claim 7, wherein the cartridge comprises lateral side walls, each of the lateral side walls comprise a second fastening member that engages the fastening member of the frame.

9. The apparatus of claim 1, wherein the cartridge comprises a front face and a rear face, the front face comprising a convex shape and the rear face comprising a flat shape.

10. A wearable apparatus comprising:

a wristband comprising a first band portion and a second band portion;

a frame removably coupled to the first band portion and the second band portion of the wristband, the frame comprising a bottom wall, an upper wall, and a pair of lateral walls defining a receptacle;

a cartridge removably attached to the frame within at least a portion of the receptacle of the frame, the cartridge comprising an interior reservoir and a fluid extraction port;

a fluid transfer conduit disposed within the interior reservoir of the cartridge and having a lower end disposed adjacent to an inner surface of a lower end of the cartridge and an upper end coupled to an inside surface of the cartridge and disposed adjacent to the fluid extraction port of the cartridge, a housing located above the upper wall of the frame, the housing comprising an electric pump assembly in communication with the fluid transfer conduit of the cartridge, wherein the housing further comprises:

a sensor;

a processor in communication with the sensor, the processor configured to process information from the sensor; and a control unit in communication with the processor and coupled to the electric pump assembly, the processor configured to send a signal to the control unit to actuate the electric pump assembly; and a rotatable nozzle removably attached to the electric pump assembly.

11. The wearable apparatus of claim 10, wherein the sensor comprises a touch screen, an accelerometer, a gyroscope, a magnetometer, or combinations thereof.

12. The wearable apparatus of claim 11, wherein the control unit is configured to actuate a piston to dispense a fluid from the cartridge based on a signal from the sensor.

13. The wearable apparatus of claim 10, further comprising a removable slot in the frame for receiving a radio-frequency identification device.

14. The wearable apparatus of claim 10, further comprising an LCD device removably attached to the wristband.

15. The wearable apparatus of claim 14, wherein the LCD device comprises a housing having a first connection means and a second connection means on opposing sides of the housing.

16. The wearable apparatus of claim 15, wherein the wristband comprises a first distal end and second distal end, wherein the first distal end and the second distal end comprise a magnetic fastening member.

17. The wearable apparatus of claim 16, wherein the first distal end and the second distal end are configured to removably attach the wristband to the first connection means and the second connection means of the housing of the LCD device.

18. A wearable apparatus comprising:

a wristband comprising a first band portion and a second band portion, wherein the wristband comprises a first distal end at the first band portion and second distal end at the second band portion;

a frame removably coupled to the first band portion and the second band portion of the wristband, the frame comprising a bottom wall, an upper wall, and a pair of lateral walls defining a receptacle;

a cartridge removably attached to the frame within at least a portion of the receptacle of the frame, the cartridge comprising an interior reservoir and a fluid extraction port;

a fluid transfer conduit disposed within the interior reservoir of the cartridge and having a lower end disposed adjacent to an inner surface of a lower end of the cartridge and an upper end coupled to an inside surface of the cartridge and disposed adjacent to the fluid extraction port of the cartridge, a housing located above the upper wall of the frame, the housing comprising an electric pump assembly in communication with the fluid transfer conduit of the cartridge;

an LCD device removably attached to the wristband, wherein the LCD device comprises a housing having a first connection means and a second connection means on opposing sides of the housing, wherein the first distal end of the first band portion and the second distal end of the second band portion are configured to removably attach the wristband to the first connection means and the second connection means of the housing of the LCD device; and a rotatable nozzle removably attached to the electric pump assembly.

* * * * *